United States Patent [19]

Stäbler

[11] Patent Number: 4,714,015

[45] Date of Patent: Dec. 22, 1987

[54] SEALING ARRANGEMENT FOR A MEDIUM-CONTAINING CHAMBER OF A DUAL BELT PRESS

[75] Inventor: Gerhard Stäbler, Murr, Fed. Rep. of Germany

[73] Assignee: Santrade Ltd., Lucerne, Switzerland

[21] Appl. No.: 878,022

[22] Filed: Jun. 24, 1986

[30] Foreign Application Priority Data

Jul. 13, 1985 [DE] Fed. Rep. of Germany ..... 3525154

[51] Int. Cl.[4] ..... B30B 5/04

[52] U.S. Cl. ..... 100/154; 100/93 RP; 156/555; 156/583.5; 277/34; 277/34.3; 425/371

[58] Field of Search ..... 100/154, 151, 153, 93 RP; 156/583.5, 555; 425/371; 277/213, 200, DIG. 7, 34, 34.3

[56] References Cited

U.S. PATENT DOCUMENTS

| | | | |
|---|---|---|---|
| 3,620,158 | 11/1971 | Torelli et al. | 100/154 |
| 4,193,342 | 3/1980 | Held | 100/154 |
| 4,253,391 | 3/1981 | Held | 100/154 |
| 4,285,525 | 8/1981 | Held | 100/154 |
| 4,331,073 | 5/1982 | Girola | 100/154 |
| 4,526,386 | 7/1985 | Repezla | 277/213 X |
| 4,537,408 | 8/1985 | Pankoke | 277/34 |
| 4,555,988 | 12/1985 | Pankoke | 100/154 |
| 4,665,819 | 5/1987 | de Brock | 100/154 |

FOREIGN PATENT DOCUMENTS

| | | | |
|---|---|---|---|
| 1934641 | 1/1970 | Fed. Rep. of Germany . | |
| 3126969 | 1/1983 | Fed. Rep. of Germany | 425/371 |
| 3129206 | 2/1983 | Fed. Rep. of Germany | 425/371 |
| 2722197 | 6/1985 | Fed. Rep. of Germany . | |
| 3417288 | 11/1985 | Fed. Rep. of Germany . | |
| 1401438 | 7/1975 | United Kingdom | 277/34.3 |
| 334088 | 3/1972 | U.S.S.R. | 100/154 |

*Primary Examiner*—James Kee Chi

*Attorney, Agent, or Firm*—Burns, Doane, Swecker & Mathis

[57] ABSTRACT

A dual belt press comprises opposed movable belts and a chamber disposed adjacent one of said belts for containing a medium to be applied to such belt. The chamber is defined by a frame. A seal for the medium is carried by the frame. The frame includes a holder attached to said frame and defining a serpentine groove. The holder comprises separate ledges disposed on opposite sides of the groove and defining the groove. Each ledge comprises a plurality of pieces abutting each other in the direction of belt travel. Pieces on opposite sides of said groove are mutually separable in a direction transverse to the direction of belt travel. A sealing strip is mounted in the groove.

10 Claims, 9 Drawing Figures

SEALING ARRANGEMENT FOR A MEDIUM-CONTAINING CHAMBER OF A DUAL BELT PRESS

BACKGROUND AND OBJECTS OF THE INVENTION

The invention relates to a sealing arrangement for the press zone of a dual belt press equipped with pressure chambers and/or lubricant chambers, consisting of sealing strips held on press plates and receiving in a groove a profiled sealing joint abutting against a revolving belt.

Sealing arrangements for dual belt presses are known (e.g. see DE-OS No. 19 34 641). These sealing arrangements are intended to seal-off the press zone in which, for example by the introduction of oil under pressure, a pressure as uniform as possible is generated in the reaction zone, while optionally also producing simultaneously a desired temperature gradient. As these sealing arrangements are abutting against the revolving belts, there arises the problem of how the sliding friction forces acting on the seals may be absorbed in a simple manner, without the risk of having the mainly elastic gaskets pulled from their grooves and folded down.

It is further known (e.g., see DE-P No. 27 22 197) to encompass the sliding seals in U-shaped ledges, equipped with special angle supports which absorb the shear forces and also retain the possibility to have the seals themselves pressured by the pressure medium against the revolving belts. However, such sealing configurations are very costly and failure prone in actual operations.

In addition, it is known (e.g., see DE-OS No. 34 17 288) to configure the seals as serpentine-shaped members, whereby the friction forces exerted by the belt against the seal will be directed generally transversely of the extent of the seal, so the seal will not be displaced from its mounting groove. However, the mounting of the seals into the press frame can be accomplished only with great difficulty.

It is an object of the present invention to develop a sealing arrangement of the above-mentioned serpentine type wherein the shear forces acting in the longitudinal direction may be effectively absorbed and wherein the sealing strips can be easily mounted in the press frame.

SUMMARY OF THE INVENTION

This object is attained according to the invention in that the seal-receiving groove is formed by a gap between two relatively transversely movable clamping ledges. Furthermore, each ledge is formed by pieces which abut one another in the direction of belt travel. With such an arrangement, the serpentine configuration of the seal strip may be effected in a very simple manner and the installation of the elastic seal strip is relatively easy, even if it is in the form of a linear sealing strip with a constant profile (i.e., not serpentine). The strip is inserted with the ledges in a transversely separated state; then the ledges are transversely converged to clamp and shape the seal strip.

The ledge pieces may be chosen in relation to their height and material so that they are able to act as slide holders for the belts, thereby essentially absorbing the compression forces acting perpendicularly to the belts.

The sealing strip may be held in the groove simply by providing the latter with at least one cross-sectional area tapering (expanding) conically toward the associated belt. The tapering area extends appropriately to about one-half of the height of the groove. If the profiled sealing shape is in the form of a sealing strip adapted to this cross-section, it may be inserted in a simple fashion by the mutual transverse displacement of the clamping ledges without the need for an excessive mounting effort. This may also be attained by providing the sealing strip in the form of an inflatable hollow shape. The groove has a serpentine-like configuration at least in the zone extending parallel to the direction of the motion of the belt. As the result of this configuration, the seal extends in the direction of the belt motion in very small areas only. Consequently, the seal is stressed by the frictional forces mainly in a direction transverse to the groove and is therefore able to absorb shear forces in a simple manner by resting alternatingly against the left or the right lateral surfaces.

THE DRAWING

The invention is illustrated by means of preferred embodiments thereof explained in the description below. In the drawing.

DETAILED DESCRIPTION OF PREFERRED EMBODIMENTS OF THE INVENTION

Figure 1:
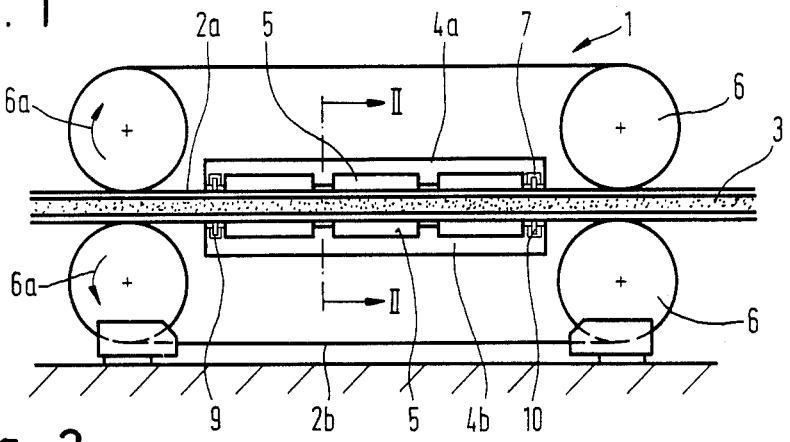
FIG. 1 shows a schematic longitudinal section through a dual belt press with a press zone equipped with pressure chambers.
Figure 2:
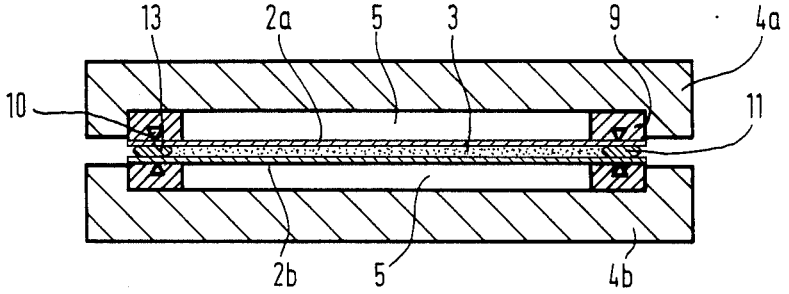
FIG. 2 is a schematic view of the cross-section along line II—II through FIG. 1.

In FIG. 1, a dual belt press 1 is schematically indicated; it comprises two endless revolving belts 2*a*, 2*b* running over reversing rolls 6, one of which is driven in the direction of the arrows 6*a*. The material 3 to be pressed is introduced in the direction of the motion of the two opposed flights of the endless belts and then exposed to a predetermined pressure. For certain substances, it is necessary or at least useful to maintain the material 3 not only under a certain pressure but also at a certain temperature or to heat it to such a temperature. In the press zone the dual belt press 1 is therefore equipped with pressure chambers 5, into which, for example, pressurized oil is introduced. The oil effects a uniform transfer of the compression pressure, increases the temperature of the material 3 by heat transfer through the belts, which usually are made of steel.

In order to seal off the pressure chambers 5 to the outside, holders or slide cleats 9 are provided into which are mounted profiled sealing strips 10, the strips abutting against the revolving steel belts 2a, 2b. The slide cleats 9 are fastened to associated press plates 4a, 4b of the press frame by being inserted into corresponding grooves 7 which extend circumferentially around the press zone. If an additional lateral seal is desired between the belts 2a, 2b, profiled sealing strips 11 traveling with the belts are provided in a known manner. These, however, are usually required only if the material 3 to be pressed tends to flow out laterally from the press zone.

Figure 3:
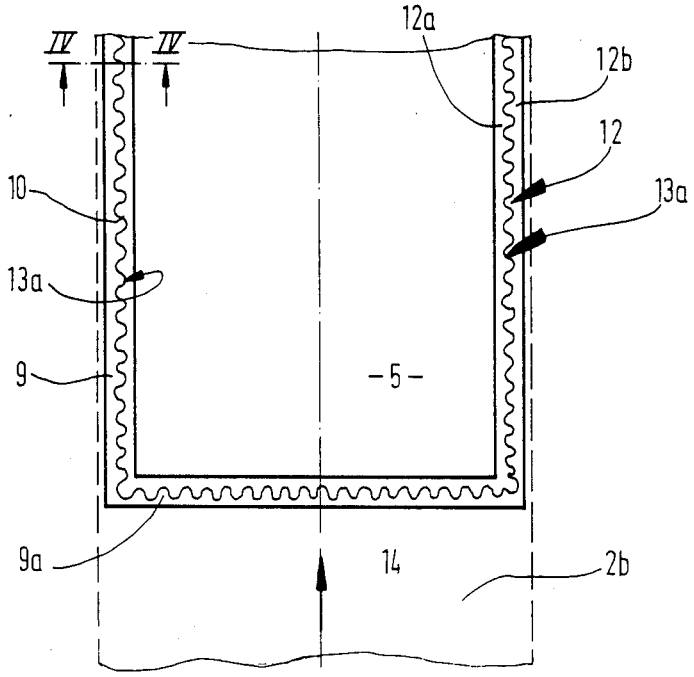
FIG. 3 is a schematic top view on a part of the press zone with a circumferential sealing frame and the sealing strip inserted in the manner of a serpentine.

FIG. 3 is a schematic view of the configuration of the slide cleats 9, which define a frame surrounding the press zone. This frame is formed, at least in the regions wherein the slide cleats 9 extend parallel to the direction 14 of the belt motion, of seal holders 12, each comprising two adjacent clamping ledges 12a, 12b which clamp the sealing strip therebetween within a groove 13 defined by the ledges. Such an arrangement of clamping ledges 12a, 12b may also be provided in the regions 9a extending transversely to the belt motion direction 14, but must always be provided in the area 13a of the groove 13 extending parallel to the belt motion direction 14. In these regions, the sealing strip 10 is inserted in a serpentine-like manner, so that it is exposed to shear forces of the sliding friction forces not exclusively in its longitudinal direction. Rather, the serpentine sealing strip 10 is exposed alternatingly also to transverse forces and is therefore not compressed in the longitudinal direction so as to be pressured out of the groove 13.

Figure 4:
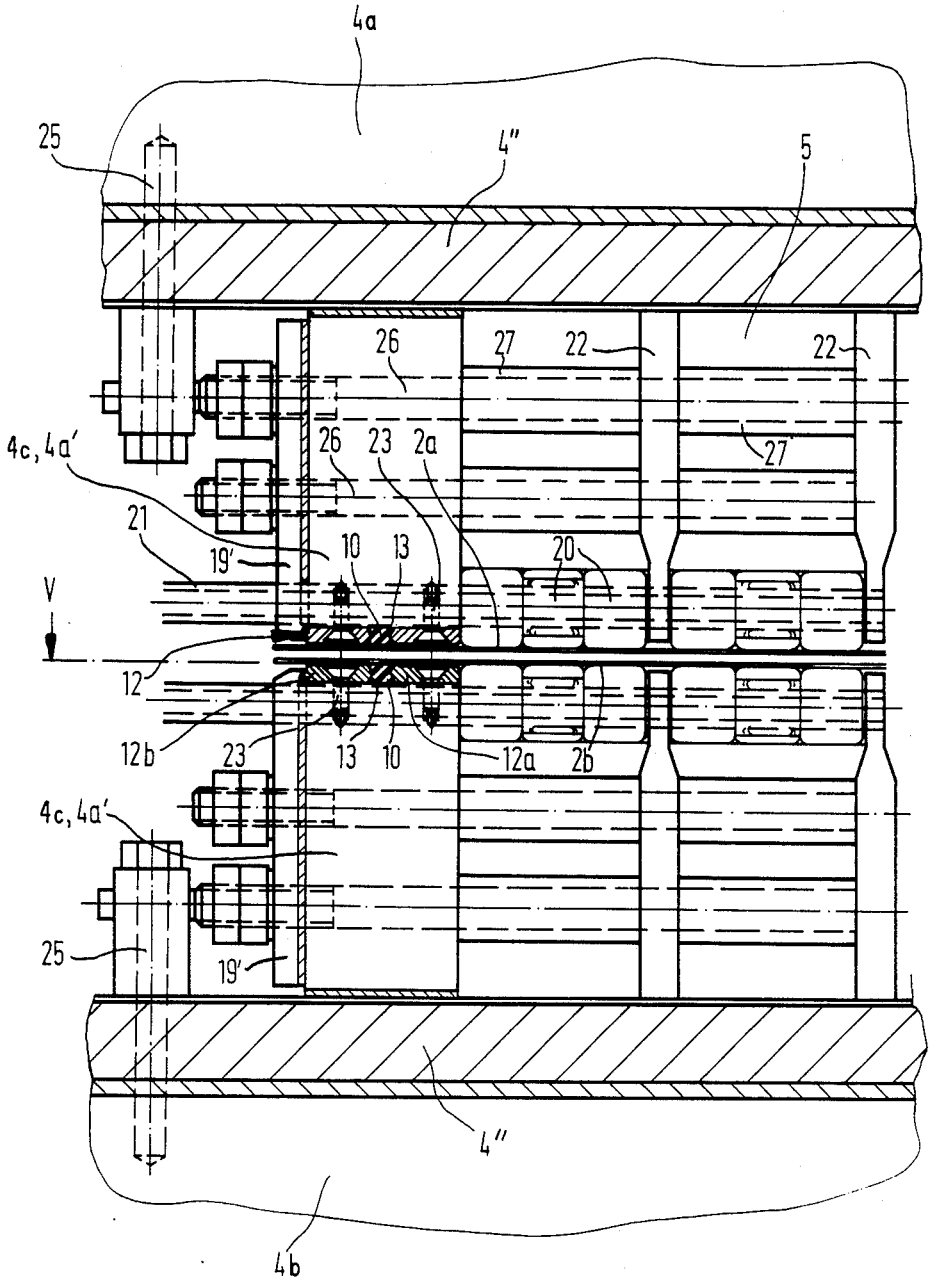
FIG. 4 is a cross-section taken along line IV—IV in FIG. 3 through one of the sealing arrangements of a dual belt press equipped with a stationary roll abrading installation that may be sprayed with lubricants or in which pressurized oil or compressed air is also used.

FIG. 4 shows that the two opposing flights 2a and 2b of the revolving belts are supported in the press zone and at the lower edge of the pressure chambers additionally by rolls 20 mounted on continuous axles 21. These axles 21 are supported by the press plates at certain intervals over the width of the belts by means of spacers 22. Pressurized oil, compressed air or merely a lubricant may be introduced into the pressure chambers 5 which are sealed to the outside by the sealing strip 10. The sealing strip 10 is seated between the clamping ledges 12a and 12b which are individually fastened to outer legs 4c of the press plates. The clamping ledges form together the seal holder 12. The clamping ledges 12a and 12b form between their opposed edges the groove or gap 13, into which the sealing strip 10 is inserted. Each of the two clamping ledges 12a and 12b is fastened with screws 23 to the leg 4c. The transversely outer clamping ledge 12b has an outer edge abutting against a stop 19' formed by a plate fastened on the leg 4c of the press plates 4a, 4b. The pressure of the medium within the chamber 5 presses the entire sealing arrangement against the stop 19'.

Figure 5:
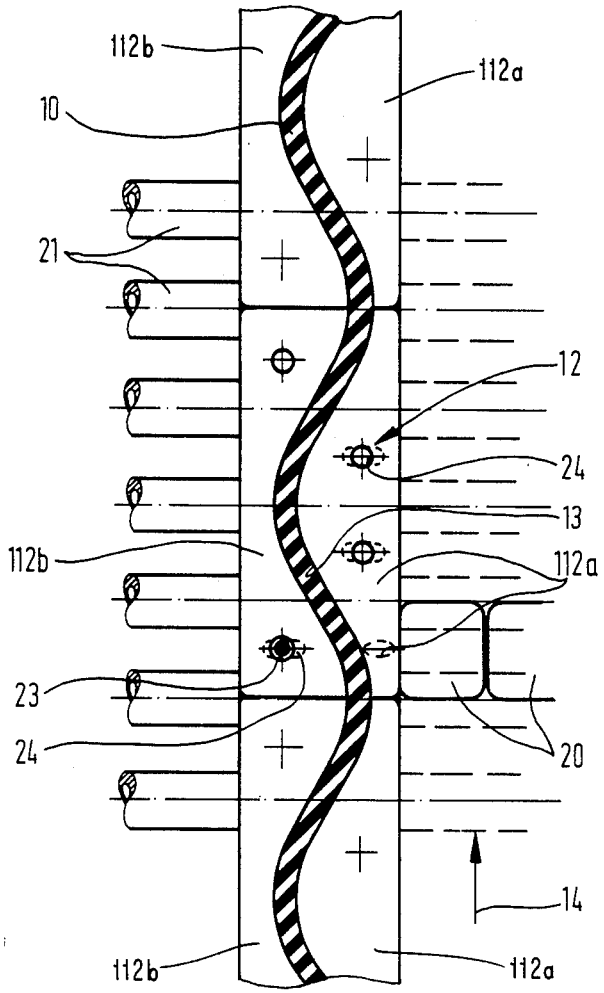
FIG. 5 is a top elevation of a part of the sealing of FIG. 4 viewed along the line V.

As depicted in FIG. 5, each of the clamping ledges is built-up of a plurality of partial pieces 112a or 112b resting against each other in the belt motion direction 14. The pieces 112a, 112b are provided with elongated holes 24, making possible displacement thereof transverse to the belt motion direction 14 to vary the width of the gap 13 between the pieces 112a, 112b. The pieces 112a, 112b have configurations such that the gap 13 extends in the shape of a serpentine into which the sealing strip 10 is clamped, which in this embodiment has a constant cross-section.

The pressurized oil may be introduced into the pressure chambers through feeder lines 25, whereby the pressurized oil is able to flow into the pressure chamber through hollow tie bolts 26 which also serve as transverse fasteners. Between the spacers 22 on the one hand, and between the last spacer 22 and the leg 4c on the other hand, spacer sleeves 27 are inserted. For thermal insulation, the press plates 4 are isolated from the press and temperature zone by an intermediate insulating layer 4''.

Figure 6:
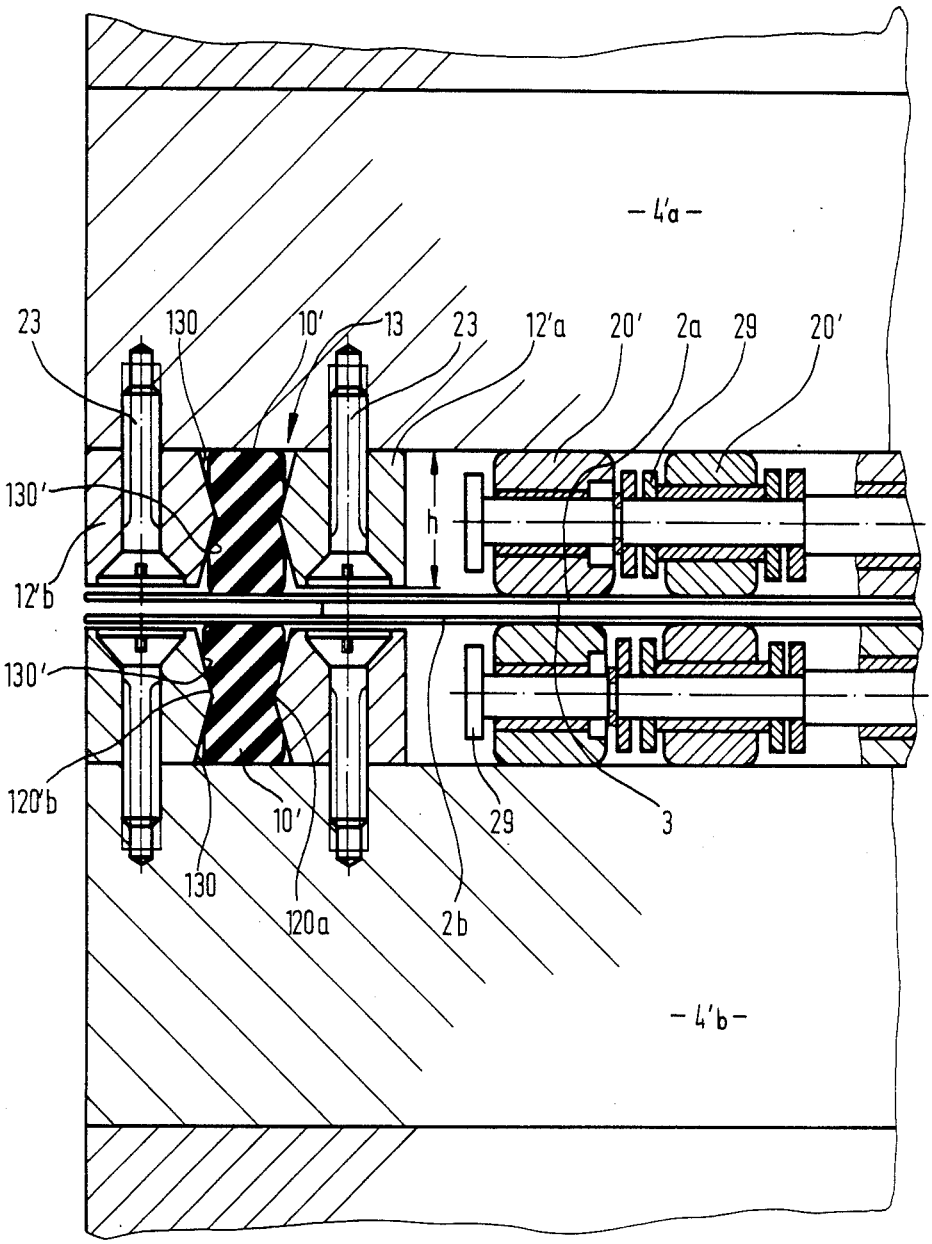
FIG. 6 is a partial section similar to FIG. 4 in an enlarged view and with a different configuration of the dual belt press, i.e., with abrasion by means of revolving rolls which may be sprayed with lubricants, or in which material is removed additionally with pressurized oil or compressed air.

In another embodiment of the invention, depicted in FIG. 6, the clamping ledges 12'a and 12'b which are higher than in the embodiment of FIGS. 4 and 5, are provided approximately in the center of their height h with blunt points 120'b and 120'a, which separate two conical areas 130 and 130' of the gap 13 between the clamping ledges. The half of the gap height facing the associated press plates 4'a and expanding conically in its direction is pressing (bulging) the profiled sealing strip 10' against the press plate 4'b to eliminate the height fluctuations in the strip. In this embodiment, the press plates 4'a, 4'b are directly adjacent to abrading rolls 20' which comprise part of a chain revolving between the associated press plates and the flight of the associated upper or lower belt 2a, 2b, with the links 29 of such chain being visible.

The configuration of the conical cross-sectional area 130 between the clamping ledges 12'b and 12'a assures the satisfactory fastening of the sealing strips 10'. In this case, it is possible to design the clamping ledges 12'b, 12'a in the manner shown in FIG. 5. The clamping ledges 12'a and 12'b can also serve as holders for the belts 2a, 2b, in which case they must comprise a material forming with the material of the belts 2a, 2b a low friction combination, i.e., preferably steel.

Figure 7:
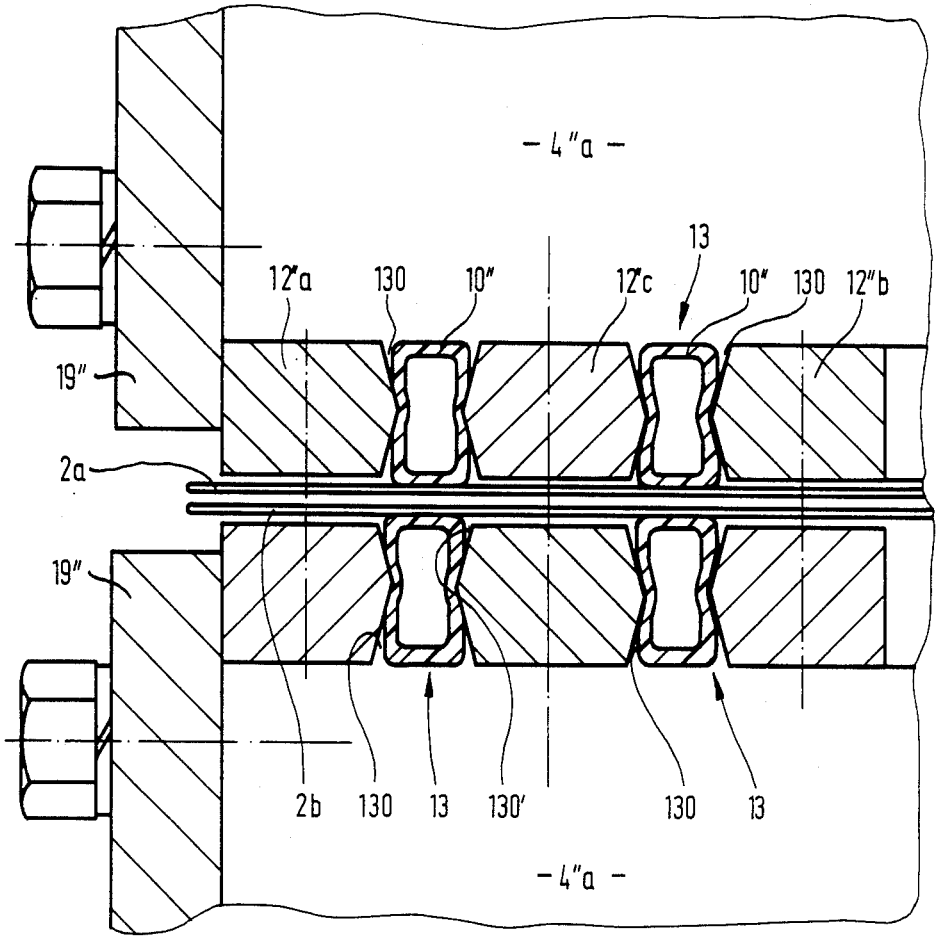
FIG. 7 is a partial section similar to FIG. 6, but depicting a further embodiment.

FIG. 7 shows a further embodiment to the extent that instead of two clamping ledges, there are employed three clamping ledges 12''a, 12''b, 12''c. These clamping ledges form a gap 13 between them, wherein the sealing strips 10'' are held. However, in this embodiment the clamping ledges 12''a, 12''b and 12''c are fastened fixedly to the associated edge 4''a of the associated upper or lower press plate. The sealing strips 10'' on the other hand, are in the form of inflatable hollow shapes and may therefore be clamped between the clamping ledges upon being inflated. These shapes are held in the conical areas 130 against the associated zones of the press plates. Although this configuration is somewhat more expensive in relation to non-inflatable sealing strips, it offers the same advantages resulting from the serpentine shape of the gap 13 as in the other embodiments. An external stop 19'' provides support for the sealing arrangement.

Figure 8A:
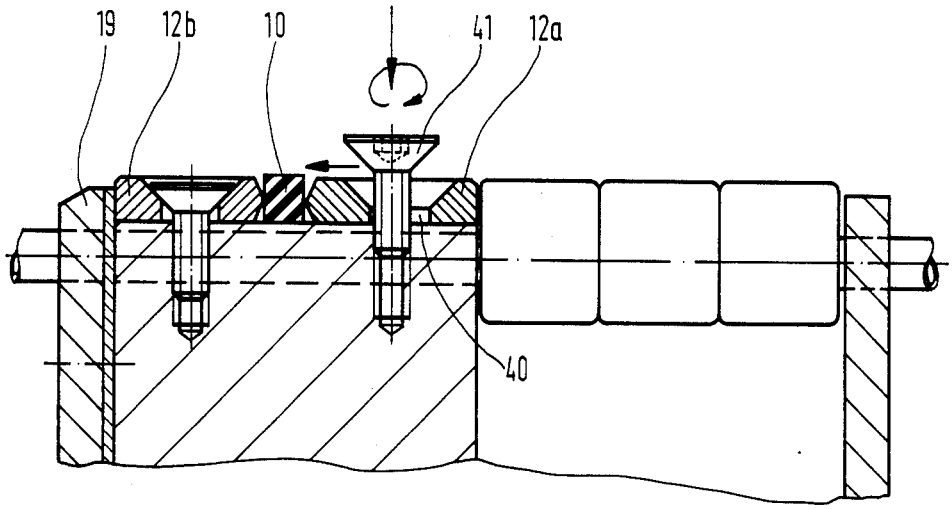
FIGS. 8*a* and 8*b* depict an arrangement similar to FIG. 5 wherein a lateral clamping action of the clamping plates on the seal is obtained by tightening countersunk screws.
Figure 8B:
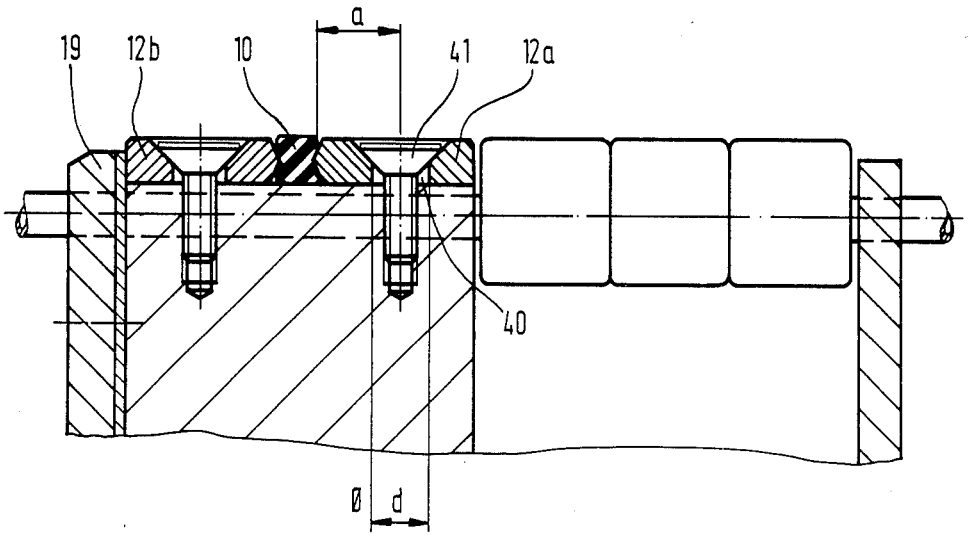

FIGS. 8a and 8b show that by means of the centering effect of the cones of countersunk screws 41 in the countersunk holes of the clamping plates 12a, the lateral displacement of the clamping plates and thus the clamping action on the seal 10 may be obtained.

It is merely necessary to choose the distance a, with an adequately large diameter d of the passage bore 40, so that following the tightening of the countersunk screws 41, i.e., after centering by the cone, the clamping plates are pressured sufficiently against the seal 10.

The loosening of the countersunk screws 41 eliminates the centering effect of the cones. The clamping plates 12a may be moved slightly in the lateral direction, since the passage bore 40 is larger than the external diameter of the threading, and the seal may be installed or removed conveniently. As mentioned above, the distance a must be adjusted for the clamping action and the diameter d must be sufficiently large. As the clamping plates 12*a* are mass-produced parts, the necessary accuracy in manufacturing may be obtained without any particular expense. The distance a and thus the clamping action on the seal are determined empirically.

Although the present invention has been described in connection with preferred embodiments thereof, it will be appreciated by those skilled in the art that modifications, substitutions, additions and deletions not specifically described may be made without departing from the spirit and scope of the invention as defined in the appended claims.

What is claimed is:

1. In a dual belt press of the type comprising opposed movable belts and means defining a chamber disposed adjacent one of said belts for containing a medium to be applied to said one belt, said chamber-defining means including a frame, and sealing means for sealing said medium in said chamber, said sealing means comprising first sealing portions extending generally parallel to the direction of belt travel and second sealing portions extending transversely of the direction of belt travel, at least said first sealing portions each comprising:

holder means attached to said frame and defining a serpentine groove extending generally in the direction of belt travel and being disposed generally in a plane, said holder means comprising separate ledges disposed on opposite sides of said groove and defining said groove, each said ledge comprising a plurality of pieces abutting each other in the direction of belt travel, pieces on opposite sides of said groove being displaceable in a direction transverse to the direction of belt travel and parallel to said plane of said groove, and a sealing strip mounted in said groove so as to be of serpentine configuration generally in the direction of belt travel, said strip being insertable in said groove means with said ledges mutually separated and secured in response to said ledges being brought together.

2. Apparatus according to claim 1, wherein said ledges compress said seal strip in the transverse direction to bulge said strip toward the associated belt.

3. Apparatus according to claim 1, wherein said groove has a cross-section which expands toward the associated belt.

4. Apparatus according to claim 3, wherein the portion of said groove which expands toward the associated belt extends for about one-half the height of the groove.

5. Apparatus according to claim 1 including a stop extending along an outside edge of a transversely outer one of said ledges, and means for pressurizing said chamber whereupon said ledges are pushed toward said stop.

6. Apparatus according to claim 1, wherein transversely movable ones of said ledges include transversely elongate bores, fasteners having conical heads being insertable into said bores such that said conical heads engage sides of said bores to cam said movable ledge toward the seal strip.

7. Apparatus according to claim 1, wherein the cross-sectional shape of said strip conforms to that of said groove.

8. Apparatus according to claim 1, wherein the cross-sectional shape of said strip in a relaxed state thereof differs from that of said groove, said strip being elastic and deformed by said ledges.

9. Apparatus according to claim 1, wherein said sealing strip is inflatable.

10. Apparatus according to claim 1, wherein said sealing strip is elastic and is formed in the shape of a linear sealing strip, said linear sealing strip being shaped by said groove defining ledges.

* * * * *